US007845960B2

(12) United States Patent
Li et al.

(10) Patent No.: US 7,845,960 B2
(45) Date of Patent: Dec. 7, 2010

(54) ELECTRICAL CONNECTOR FOR RECEIVING AN ELECTRICAL CARD ASSEMBLY

(75) Inventors: Hua Li, Kunshan (CN); Zhen-Hua Wang, Kunshan (CN); Xiao-Gao Yang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 5 days.

(21) Appl. No.: 12/322,492

(22) Filed: Feb. 2, 2009

(65) Prior Publication Data

US 2009/0197431 A1 Aug. 6, 2009

(30) Foreign Application Priority Data

Feb. 1, 2008 (CN) ..... 2008 2 0031480 U

(51) Int. Cl.
*H01R 12/00* (2006.01)

(52) U.S. Cl. ..... 439/79

(58) Field of Classification Search ..... 439/79, 439/63

See application file for complete search history.

(56) References Cited

U.S. PATENT DOCUMENTS 5,090,116 A * 2/1992 Henschen et al. ..... 29/827
5,184,961 A * 2/1993 Ramirez et al. ..... 439/59
5,238,413 A * 8/1993 McCaffrey et al. ..... 439/79
5,437,562 A * 8/1995 Michael ..... 439/581
5,443,403 A * 8/1995 Weidler et al. ..... 439/701
5,549,480 A * 8/1996 Cheng ..... 439/79
5,772,471 A * 6/1998 Buck ..... 439/607.28
D408,789 S * 4/1999 Middlehurst et al. ..... D13/154
6,144,561 A * 11/2000 Cannella et al. ..... 361/796
6,361,372 B1 * 3/2002 Chiang ..... 439/680
6,558,201 B1 * 5/2003 Begley et al. ..... 439/638
6,648,695 B1 * 11/2003 Wu ..... 439/638
6,722,923 B2 * 4/2004 Huang ..... 439/607.53
6,781,391 B2 * 8/2004 Reed et al. ..... 324/754
6,796,843 B1 * 9/2004 Ryan et al. ..... 439/638
6,830,483 B1 * 12/2004 Wu ..... 439/638
7,416,415 B2 * 8/2008 Hart et al. ..... 439/63
2004/0259395 A1 * 12/2004 Yang et al. ..... 439/79
2008/0293286 A1 * 11/2008 Denpouya ..... 439/358
2009/0221172 A1 * 9/2009 Li ..... 439/328

* cited by examiner

*Primary Examiner*—T C Patel
*Assistant Examiner*—Harshad C Patel
(74) *Attorney, Agent, or Firm*—Andrew C. Cheng; Wei Te Chung; Ming Chieh Chang

(57) ABSTRACT

An electrical connector (1) for receiving an electrical card assembly (3) which having at least one first cable connecting member (31), includes an insulative housing (10), a plurality of contacts (11) received in the housing and at least one extending portion (4). The insulative housing defines a longitudinal main body (100) with a slot (101) extending along a longitudinal direction. The at least one extending portion is disposed at one end of the main body. The at least one extending portion is used for receiving and retaining a second cable connecting member therein to connect with the first cable connecting member.

11 Claims, 4 Drawing Sheets

ELECTRICAL CONNECTOR FOR RECEIVING AN ELECTRICAL CARD ASSEMBLY

BACKGROUND OF THE INVENTION

1. Field of the Invention

The present invention relates to an electrical connector, and especially to a card edge connector for receiving an electrical card assembly.

2. Description of the Related Art

Most of the conventional electronic products are suitable for miniaturization and multifunction. For example, a Mini PCI card used in a notebook is usually assembled with exterior cables to enhance the functions of the notebook. During the card are connected to exterior cables in a conventional electrical connector, the exterior cables should be inserted into the receiving holes disposed in the card to connect with the card. But the Mini PCI card is miniaturized, the receiving holes provided for receiving the exterior cables are very small, so that it is very hard to insert the exterior cables into the corresponding receiving holes accurately, and the imprecise inserting may destroy the connection between the card and the exterior cables. Hence, an electrical connector which can connect the card easily to exterior cables is required.

SUMMARY OF THE INVENTION

Accordingly, an object of the present invention is to provide an electrical connector which can connect the card assembly easily to exterior cables.

In order to achieve the object set forth, an electrical connector for receiving an electrical card assembly which having at least one first cable connecting member, includes an insulative housing, a plurality of contacts received in the housing and at least one extending portion. The insulative housing defines a longitudinal main body with a slot extending along a longitudinal direction. The at least one extending portion is disposed at one end of the main body. The at least one extending portion is used for receiving and retaining a second cable connecting member therein to connect with the first cable connecting member.

Other objects, advantages and novel features of the invention will become more apparent from the following detailed description of the present embodiment when taken in conjunction with the accompanying drawings.

DETAILED DESCRIPTION OF THE INVENTION

Figure 1:
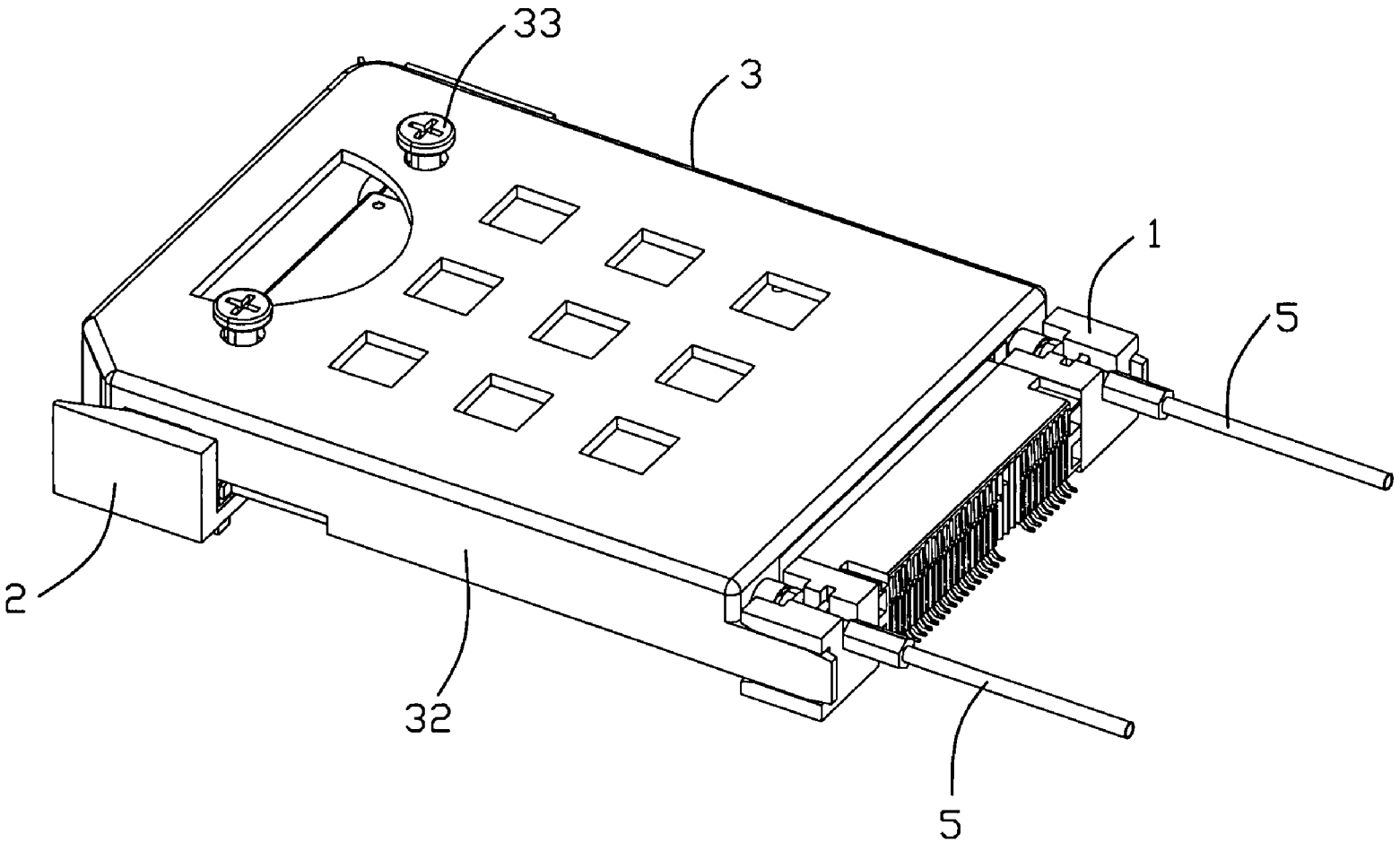
FIG. 1 is an assembled perspective view of an electrical connector receiving and retained an electrical card assembly co-operating with a latching device.

Reference will now be made to the drawing figures to describe a preferred embodiment of the present invention in detail.

Figure 2:
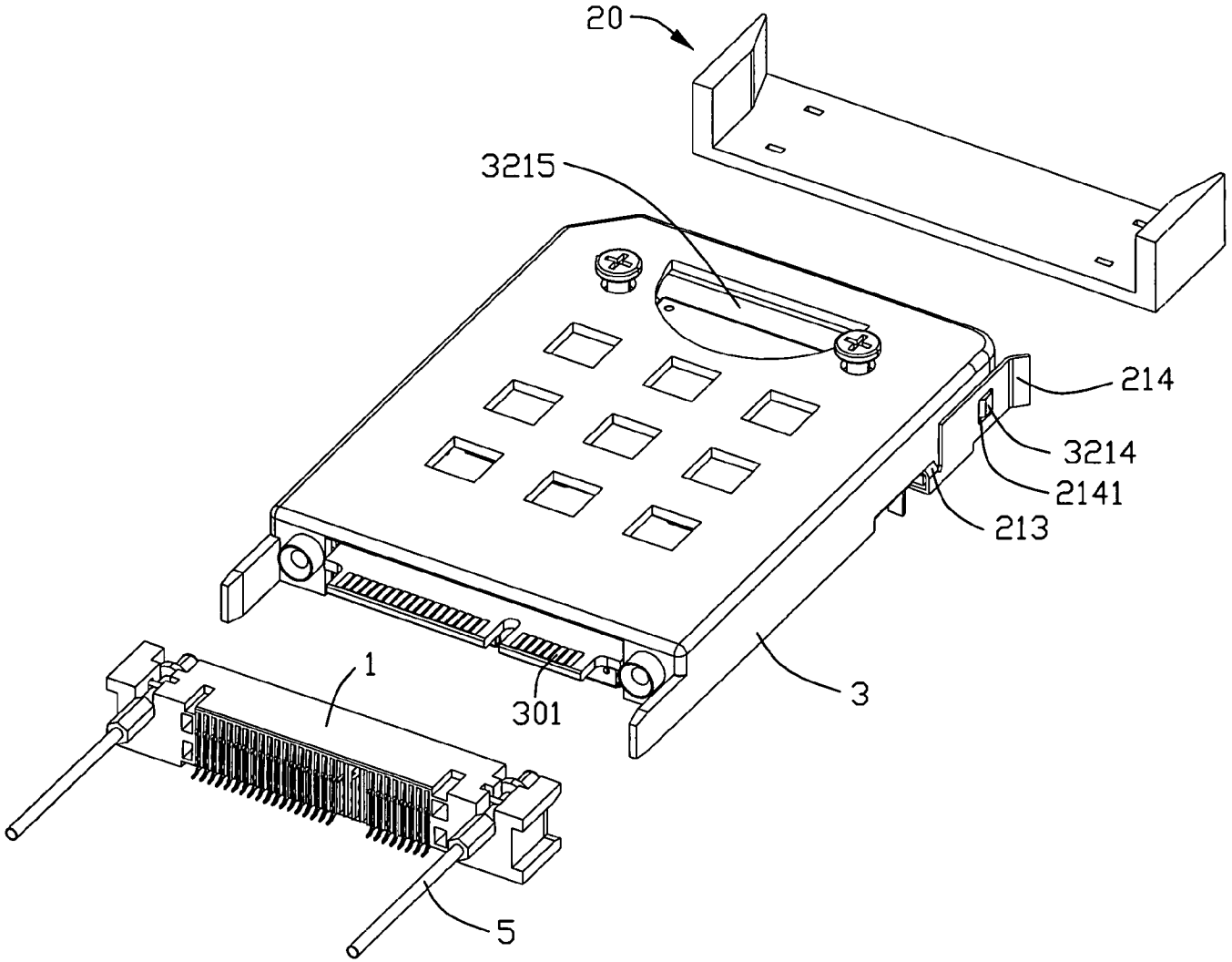
FIG. 2 is a partly exploded view of the assembled perspective view shown in FIG. 1.

Referring to FIG. 1 and FIG. 2, the present invention discloses an electrical connector 1 connecting to a printed circuit board (not shown). The electrical connector 1 cooperates with a separated latching device 2 to retain an electrical card assembly 3 thereof.

Figure 3:
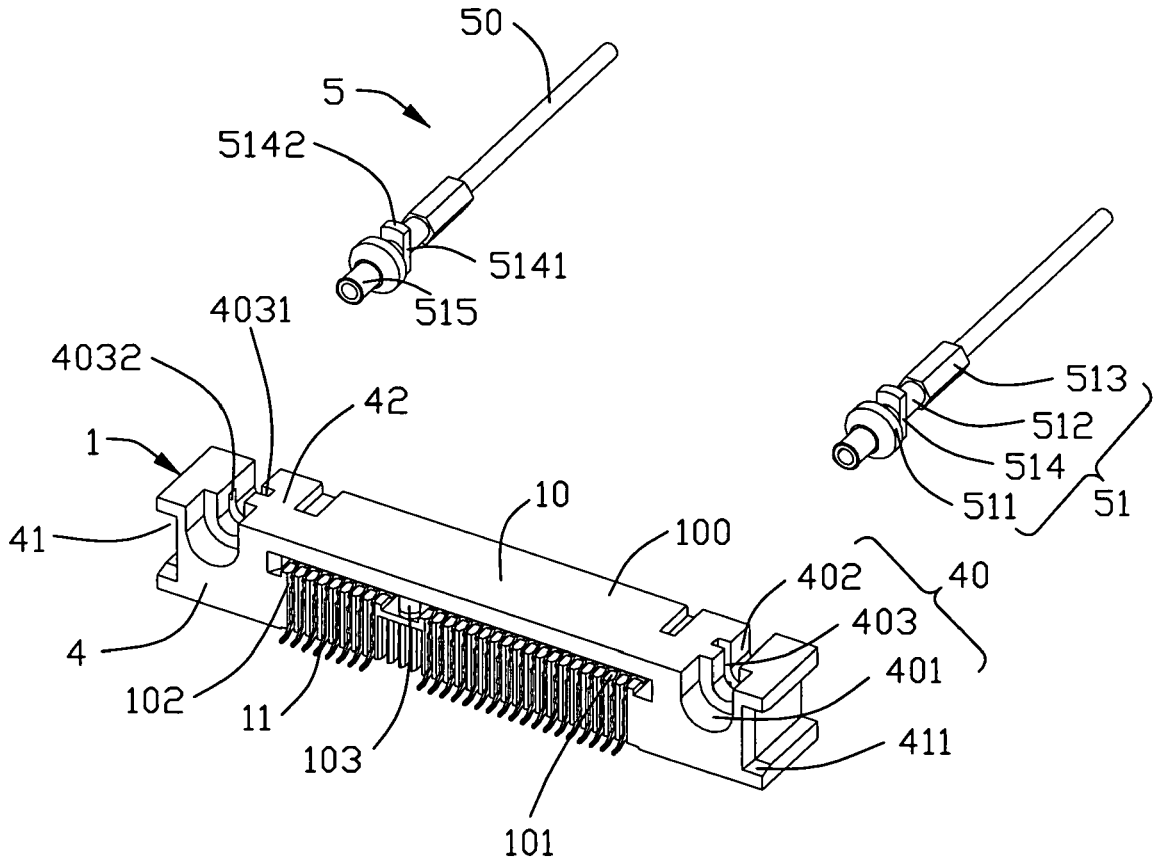
FIG. 3 is an assembled perspective view of the electrical connector and a second cable connecting members shown in FIG. 1.

Referring to FIG. 3, the electrical connector 1 includes an insulative housing 10 and a plurality of contacts 11 received in the housing 10. The housing 10 defines a longitudinal main body 100 and a pair of extending portions 4 extending along a longitudinal direction thereof from two opposite ends of the main body 100. The main body 100 defines a longitudinal slot 101 at a front face thereof along the longitudinal direction for insertion of a rear end or mating tongue 301 of the electrical card 30. A plurality of passages 102 are defined at an upper and a lower side wall of the slot 101 to receive the contacts 11 therein. A key 103 is provided at a middle portion of the slot 101 to prevent the electrical card assembly 3 from mis-mating. Each of the extending portions 4 defines a receiving groove 40, a guiding groove 41 with a guiding face 411 at a front opening, both running through the front face and the rear face along a front-to-rear direction. The receiving grooves 40 opens upwards and the guiding grooves 41 opens outwards laterally. The bottom of the receiving grooves 40 are arc shaped, each of the receiving groove 40 includes two portions, a front groove 401 and a rear groove 402 smaller than the front groove 401 in diameter. The rear groove 402 defines a locking slot 403 at a middle portion thereof, the diameter of the locking slot 403 is bigger than the rear groove 402. One end of the locking slot 403 adjacent to the main body 100 runs through a top face 42 and provides an opening 4031 at the top face 42 thereof, the other end of the locking slot 403 does not run through the top face 42 and provide a blocking portion 4032 thereof.

Referring to FIG. 2 and FIG. 3, a pair of cable connecting members 5 are assembled to the electrical connector 1. Each of the cable connecting members 5 defines a cable 50 and a connecting member 51 retained in the extending portion 4. One end of the cable 50 connects with the connecting member 51 and the other end connects to other products (not shown). The connecting member 51 includes a circle retaining portion 511 received in the front groove 401, a circle smaller retaining portion 512 received in the rear groove 402 and a rectangular retaining portion 514 between said two retaining portions received in the locking slot 403. Said three retaining portions are located in the receiving groove 40 when the cable connecting member 5 is inserted in the receiving groove 40, wherein the retaining portion 514 is inserted into the locking slot 403 with the long side 5141 thereof upright. Then the connecting members 51 are rotated as a result the opposite two arc faces 5142 of the retaining portion 514 rotate along the locking slot 403 until one end of the retaining portion 514 blocked by the blocking portion 4032, so as to retain the cable connecting members 5 to the housing 10 steadily. A pair of mating portions 515 with holes therein extend forwards from the circle retaining portions 511 and are located in front of the front face of the extending portion 4. A relief portion 513 surrounds the cable 50 and behind the retaining portion 512, which explodes behind the rear face of the extending portion 4.

Figure 4:
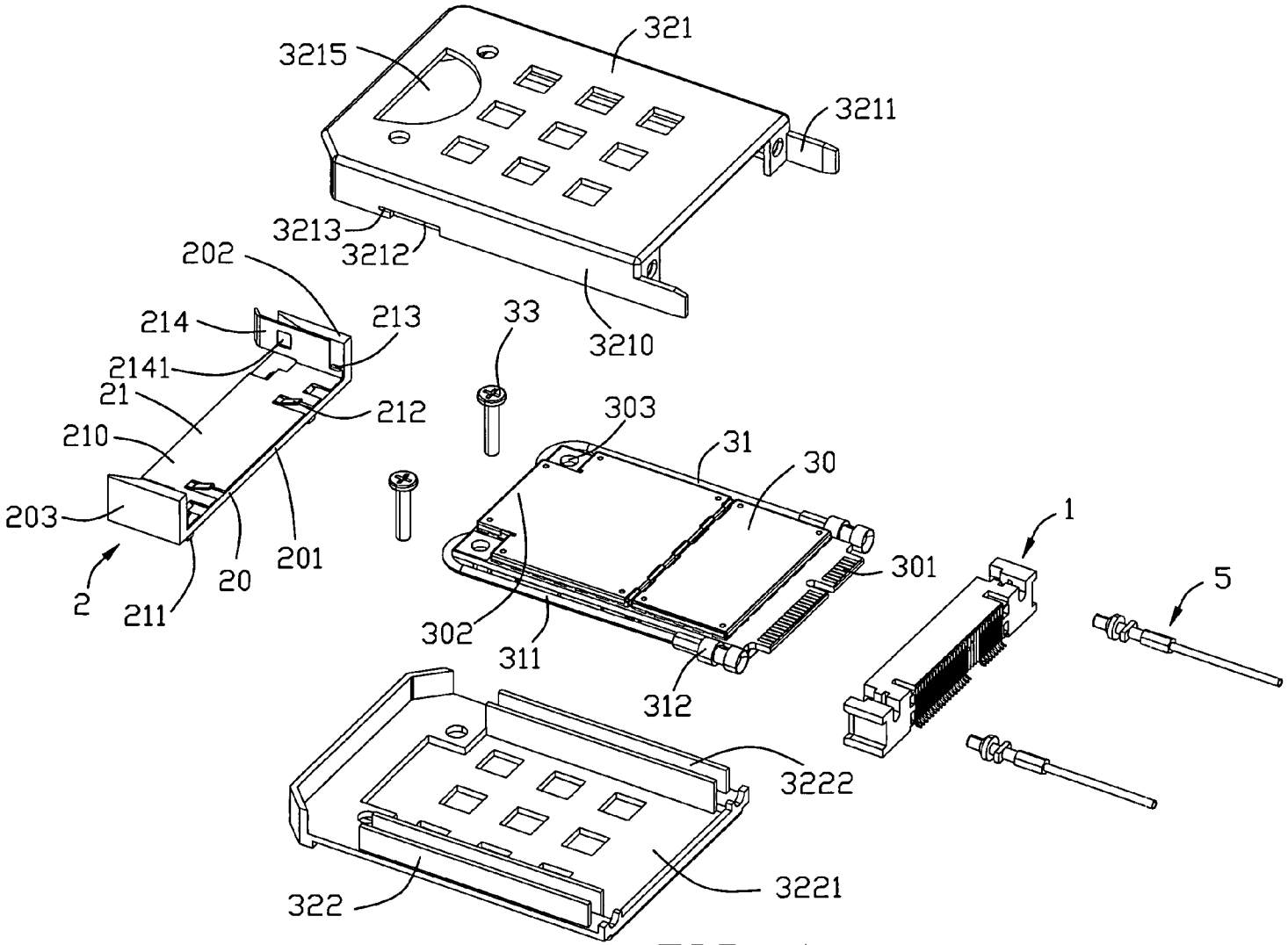
FIG. 4 is an exploded view of the assembled perspective view shown in FIG. 1.

Referring to FIG. 2 and FIG. 4, the latching device 2 includes a plastic member 20 and a metal member 21 retained in the plastic member 20. The plastic member 20 is U shaped, and defines a base portion 201 and a pair of opposite side-arms 202, 203 extending upwards from two ends of the base portion 201. Each of the side-arms 202, 203 defines a slantwise face extending outwards at the front portion of the inner face thereof. The metal member 21 defines a main portion 210 abutting against the inner surface of the base portion 201 and a pair of side pieces extending upwards from two opposite end edges and abutting against the corresponding inner face of the side-arms 202, 203. The main portion 210 defines a retaining portion 211 extending downwards therefrom and running through the base portion 201 to connect to the printed circuit board (not shown) and a pair of elastic pieces 212 extending slantways and upwards from the main portion 210. Each of the side pieces defines a locking portion 213 extending towards each other at the rear portion thereof and an operating portion 214 opposite to the slantwise face at the front portion and extending beyond the side-arm 202/203.

Referring to FIG. 2 and FIG. 4, the electrical card assembly 3 includes an electrical card 30, a pair of cable connecting members 31 separately disposed at two sides of the electrical card 30, a pair of covers 32 receiving the electrical card 30 and the cable connecting members 31 therein and a pair of bolts 33. The rear end 301 defines a plurality of conductive pads thereon, and a pair of retaining holes 303 are disposed at the front end 302 thereof. Each of the cable connecting members 31 defines a cable 311 and a connecting member 312 connecting to the cable 311. The connecting members 312 are separately positioned beside the rear end 301. One end of the cable 311 is connected to the front end 302 of the electrical card 30 and the other end is connected to the connecting member 312. The pair of covers 32 includes a first cover 321 and a second cover 322 cooperating with the first cover 321. The first cover 321 defines a flat main body and a pair of opposite side boards 3210 extending downwards from two end edges of the main body. Each of the side boards 321 defines a guiding arm 3211 extending rearwards from the rear end edge thereof, a receiving slot 3212 opening downwards and a locking slot 3213 connecting with the receiving slot 3212 at the front portion. The second cover 322 defines a first receiving cavity 3221 at a middle portion thereof and a pair of second receiving cavities 3222 positioned at two sides of the first receiving cavity 3221. The assembled electrical card 30 and the cable connecting members 31 are set into the second cover 32 with the electrical card 30 received in the first receiving cavity 3221 and the cable connecting members 31 received in the corresponding second receiving cavities 3222, then the first cover 321 is set on top of the electrical card 30, and the bolts 33 go into the aligned through holes provided at the first and second covers 31, 32 and the retaining holes 33 to provide the electrical card assembly 3 (shown in FIG. 2). The rear end 301 of the electrical card 30 is exposed out of the first receiving cavity 3221, and a free end of the connecting member 312 extends out of the second receiving cavity 3222.

Referring to FIG. 2 and FIG. 4, when the electrical card assembly 3 is assembled to the latching device 2, the locking portions 213 run into the receiving slot 3212, then drive the electrical card assembly 3 move flatly towards the electrical connector 1, the locking portions 213 move along the receiving slot 3212 until entering into the locking slots 3213 and locking with the locking slots 3213, the protrusions 3214 defined at the side boards 3210 enter into the corresponding locking hole 2141 adjacent to the operating portion 214, so as to retain the front end of the electrical card assembly 3 to the latching device 2 steadily. The pair of guiding arms 321 disposed at two front sides of the electrical card assembly 30 align with the guiding slots 41 and move along the guiding slots 41, which can guide the rear end 301 of the electrical card 30 entering into the slot 101, and synchronously make the connecting member 312 connect with the mating portion 515 to connect the cable 311 with the cable 50 exactly, so as to connect the electrical card 30 with the cable 50 easily. The bolts 33 contact with the elastic pieces 212 so as to provide a good grounding function. The cable connecting member 31 assembled to the electrical card 30 is defined as a first cable connecting member, and the cable connecting member 5 retained to the housing for connecting with the first cable connecting member is defined as a second cable connecting member.

During disassembly, push the operating portions 214 outwards to make the protrusions 3214 disengage with the locking hole 2141. Then pull the electrical card assembly 3 forwards by the operating slot 3215 to make the electrical card assembly 3 moving forwards flatly until the locking portions 213 moving out of the locking slots 3213. Synchronously, the rear end 301 of the electrical card 30 moves out of the slot 101, the guiding arms 321 break off from the guiding slots 41 and the first connecting members 312 disengaged with the mating portion 515 easily, so that the electrical card assembly 3 is separated from the electrical connector 1 completely.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for receiving an electrical card assembly which has at least one first cable connecting member, comprising:

an insulative housing defining a longitudinal main body with a slot extending along a longitudinal direction;

a plurality of contacts received in the main body; and at least one extending portion disposed at one end of the main body for receiving and retaining a second cable connecting member therein to connect with the first cable connecting member, wherein the at least one extending portion defines a receiving groove opening upwards and running through opposite front and rear faces of the at least one extending portion.

2. The electrical connector as described in claim 1, wherein the at least one extending portion extends integrally from one end of the main body.

3. The electrical connector as described in claim 1, wherein the receiving groove defines a rear groove running through the rear face of the extending portion, the rear groove defines a locking slot with a bigger diameter thereof, the locking slot defines two opposite receiving portions, and one of the receiving portions runs through a top face of the at least one extending portion and provides an opening at the top face, the other receiving portion is blocked by a blocking portion extending from the top face.

4. The electrical connector as described in claim 3, wherein the at least one extending portion defines a guiding slot opening outwards laterally to guide the electrical card assembly moving towards the electrical connector by cooperating with a guiding portion provided at the electrical card assembly.

5. An electrical connector assembly comprising:

an electrical connector comprising:

an insulative housing defining a longitudinal main body, the main body being provided with a slot extending along a longitudinal direction and defining a plurality of passages therein; and a plurality of contacts received in the corresponding passages;

an electrical card assembly connecting with the electrical connector and including an electrical card and at least one first cable connecting member connecting with the electrical card; and at least one second cable connecting member having a retaining portion thereof;

wherein the insulative housing defines at least one receiving groove disposed at one side of the main body, and the retaining portion is received in the receiving groove and rotated to lock with the housing to retain the at least one second cable connecting member in the electrical connector.

6. The electrical connector assembly as described in claim 5, wherein the housing defines at least one extending portion extending integrally from one end of the main body, and the at least one receiving groove is provided at the at least one extending portion.

7. The electrical connector assembly as described in claim 6, wherein the at least one receiving groove opens upwards and runs through the at least one extending portion along a mating direction.

8. The electrical connector assembly as described in claim 7, wherein the second cable connecting member defines a mating portion extending forwards from the retaining portion and located in front of a front face of the extending portion.

9. The electrical connector assembly as described in claim 8, wherein the first cable connecting member defines a first cable connecting with the electrical card of the electrical card assembly and a first connecting member connecting with a free end of first cable, and the first connecting member connects with the mating portion.

10. The electrical connector assembly as described in claim 5, wherein the receiving groove defines a locking slot with a large diameter thereof, the retaining portion is received and rotate in the locking slot to lock with the housing.

11. The electrical connector assembly as described in claim 10, wherein the locking slot defines two opposite receiving portions, and one of the receiving portions runs through a top face of the housing and provides an opening at the top face, the other receiving portion is blocked by a blocking portion extending from the top face.

* * * * *